US007713079B2

(12) United States Patent
Fu

(10) Patent No.: US 7,713,079 B2
(45) Date of Patent: May 11, 2010

(54) CARD EDGE CONNECTOR

(75) Inventor: Shih-Chi Fu, Taoyuan (TW)

(73) Assignee: Bellwether Electronic Corp., Taoyuan (TW)

( * ) Notice: Subject to any disclaimer, the term of this patent is extended or adjusted under 35 U.S.C. 154(b) by 0 days.

(21) Appl. No.: 12/494,175

(22) Filed: Jun. 29, 2009

(65) Prior Publication Data

US 2010/0003856 A1 Jan. 7, 2010

(51) Int. Cl.
*H01R 13/62* (2006.01)

(52) U.S. Cl. ..... 439/328

(58) Field of Classification Search ..... 439/328, 439/327, 325, 64

See application file for complete search history.

(56) References Cited

U.S. PATENT DOCUMENTS 6,478,592 B1 * 11/2002 Hu et al. ..... 439/159
6,939,157 B2 * 9/2005 Chiu ..... 439/328
7,004,773 B1 * 2/2006 Poh et al. ..... 439/160
7,344,402 B2 * 3/2008 Langgood et al. ..... 439/328

* cited by examiner

*Primary Examiner*—Phuong K Dinh
(74) *Attorney, Agent, or Firm*—Glenn H. Lenzen; Polsinelli Shughart P.C.

(57) ABSTRACT

A card edge connector includes an insulating body having opposite lateral side frames for mounting respectively two metallic pieces thereon, and terminals mounted in the insulating body and coupled to a circuit board. When an insertion side with conductive terminals of an electronic card is inserted into an insertion groove in the insulating body, the conductive terminals contact respectively contact portions of the terminals extending into the insertion groove. Each metallic piece includes first and second resilient arms extending from a base, and a carved metallic piece extending from the first resilient arm. When the insertion side of the electronic card is inserted into the insertion groove, each lateral side of the electronic card is clamped between the anchoring member and the second resilient arm of a corresponding metallic piece, and is formed with a notch engaging a projection of the second resilient arm of the corresponding metallic piece.

5 Claims, 6 Drawing Sheets

CARD EDGE CONNECTOR

CROSS-REFERENCE TO RELATED APPLICATION

This application claims priority of Taiwanese Application No. 097211684, filed on Jul. 1, 2008.

BACKGROUND OF THE INVENTION

1. Field of the Invention

The invention relates to an electrical connector, more particularly to a card edge connector.

2. Description of the Related Art

Referring to FIG. 1, a conventional card edge connector for en electronic card 6, such as a memory card, is shown to include an insulating body 7 and two metallic pieces 5.

The insulating body 7 can be mounted on a circuit board (not shown), and has a top surface 70 formed with an insertion groove (not shown) that permits insertion of an insertion side of the electronic card 6 thereinto. When the insertion side of the electronic card 6 is inserted into the insertion groove, a plurality of conductive terminals (not shown) on the insertion side of the electronic card 6 contact electrically and respectively terminals (not shown) mounted in the insulating body 7.

The metallic pieces 5 are mounted respectively on opposite lateral side framed 71 on the top surface 70 of the insulating body 7. Each metallic piece 5 includes an upright main plate body 50 having front and rear sides 501, 500, a bent anchoring portion 52 extending from the front side 501 of the main plate body 50 and disposed distal from the insulating, body 7, and an L-shaped stop 51 extending from the rear side 500 of the main plate body 50 and disposed between the anchoring portion 51 and the insulating body 7.

When the electronic card 6 is inserted into the insertion groove in the insulating body 7, the anchoring portions 52 of the metallic pieces 5 engaged respectively notches 60 in opposite lateral sides of the electronic card 6. Upon vibration of an assembly of the conventional card edge connector and the electronic card 6, disengagement between the notches 60 in the electronic card 6 and the anchoring portions 52 of the metallic pieces 5 may occur. Therefore, the conventional card edge connector cannot ensure electrical contact between the conductive terminals 70 of the electronic card 6 and the terminals of the conventional card edge connector.

SUMMARY OF THE INVENTION

Therefore, an object of the present invention is to provide a card edge connector that can overcome the aforesaid drawback of the prior art.

According to the present invention, there is provided a card edge connector adapted for electrically connecting an electronic card to a circuit board therethrough. The electronic card has a rectangular card body. The card body has an insertion side formed with a plurality of conductive terminals, and opposite lateral sides each formed with a notch distal from the insertion side. The card edge connector comprises:

an insulating body adapted to be mounted on the circuit board, and having a side surface formed with an insertion groove which permits insertion of the insertion side of the card body of the electronic card thereinto, and two lateral side frames opposite to each other in a first direction and extending from the side surface;

a plurality of terminals mounted in the insulating body, each of the terminals having a contact portion extending into the insertion groove in the insulating body, and a solder portion opposite to the contact portion, extending outwardly of the insulating body and adapted to be electrically connected to the circuit board, the contact portions of the terminals being adapted to contact electrically and respectively the conductive terminals of the electronic card when the insertion side of the card body of the electronic card is inserted into the insertion groove in the insulating body; and two metallic pieces each including a base mounted on a corresponding one of the lateral side frames of the insulating body, a first resilient arm extending from the base in a second direction that is perpendicular to the first direction, and having first and second sides opposite to each other in a third direction that is perpendicular to the first and second directions, a curved anchoring member extending from the first side of the first resilient arm portion, disposed distal from the base, and having an outer convex guiding surface, and a second resilient arm extending from the base and disposed adjacent to the second side of the first resilient arm, the second resilient arm having a free end portion opposite to the anchoring member in the third direction and formed with a projection projecting toward the anchoring member.

When the insertion side of the card body of the electronic card is inclinedly inserted into the insertion groove in the insulating body such that each of the lateral sides of the card body of the electronic card abuts against the guiding surface of the anchoring member of a corresponding one of the metallic pieces, the card body of the electronic card is pushed to move toward the second resilient arms of the metallic pieces through guiding of the guiding surfaces of the anchoring members of the metallic pieces such that each of the lateral sides of the card body of the electronic card is clamped between the anchoring member and the free end portion of the second resilient arm of the corresponding one of the metallic pieces and that the notch in each of the lateral sides of the card body of the electronic card engages the projection of the free end portion of the second resilient arm of the corresponding one of the metallic pieces, thereby ensuring electrical contact between the conductive terminals of the electronic card and the contact portions of the terminals.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
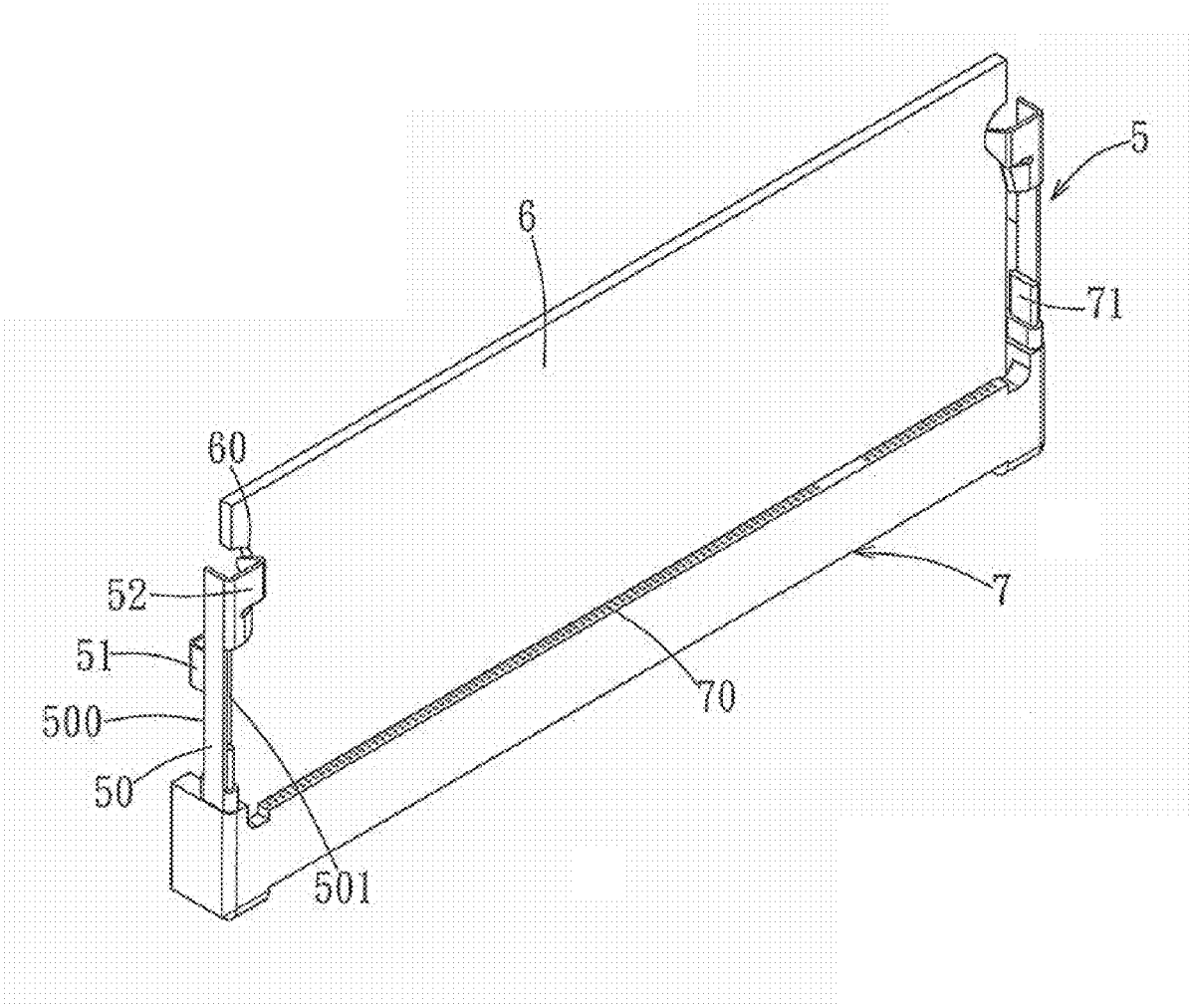
FIG. 1 PRIOR ART
FIG. 1 is a perspective view of a conventional card edge connector for an electronic card.

Referring to FIGS. 2 to 5, the preferred embodiment of a card edge connector according to the present invention is adapted for electrically connecting an electronic card 3 to a circuit board 8 therethrough. The electronic card 3 can be a single in-line memory module (SIMM) card, a dual in-line memory module (DIMM) card, a double data rate (DDR) card or an expansion card, such as a video card, a sounds card and an interface card. The electronic card 3 has a rectangular card body 30. The card body 30 has an insertion side 32 formed with a plurality of conductive terminals 33 (see FIG. 2), and opposite lateral sides 31 each forced with a notch 310 distal from the insertion side 32. In this embodiment, the notch 310 in each lateral side 31 is defined by a concave wall 34 that has a first end 341, and a second end 342 opposite to the first end 341 and closer to the insertion side 32 than the first end 341. The card edge connector includes an insulating body 1, a plurality of terminals 4, and two metallic pieces 2.

Figure 3:
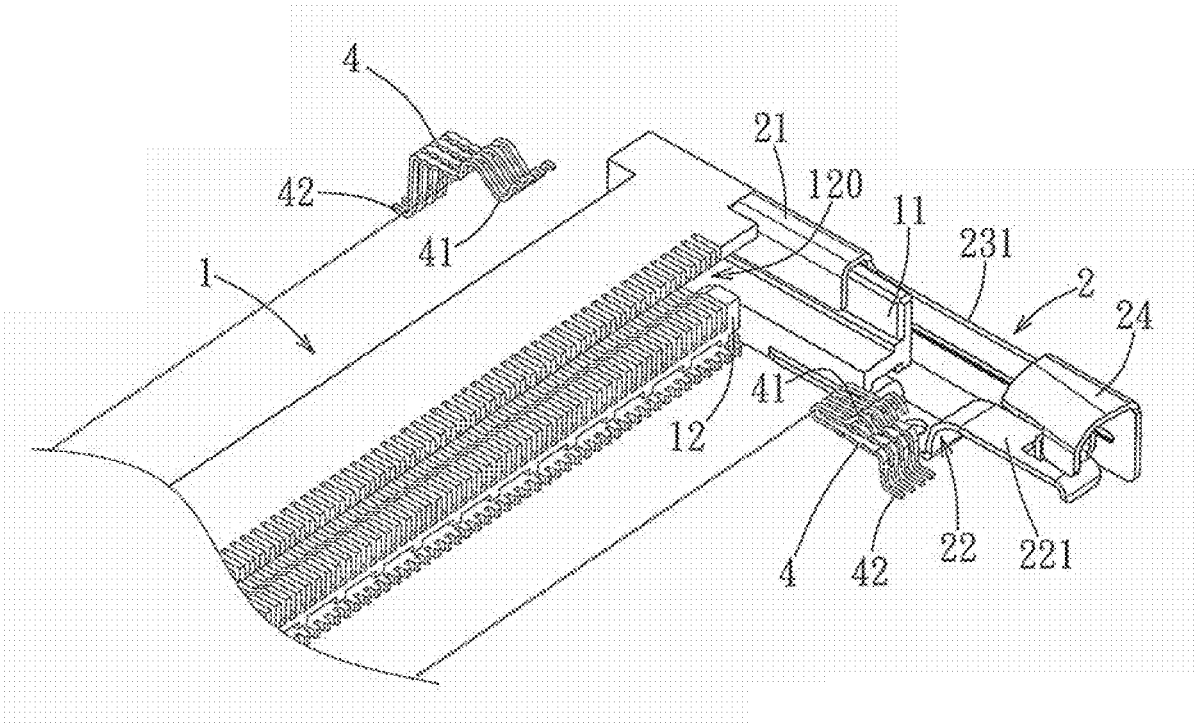
FIG. 3 is a fragmentary, partly exposed perspective view showing the preferred embodiment.
Figure 4:
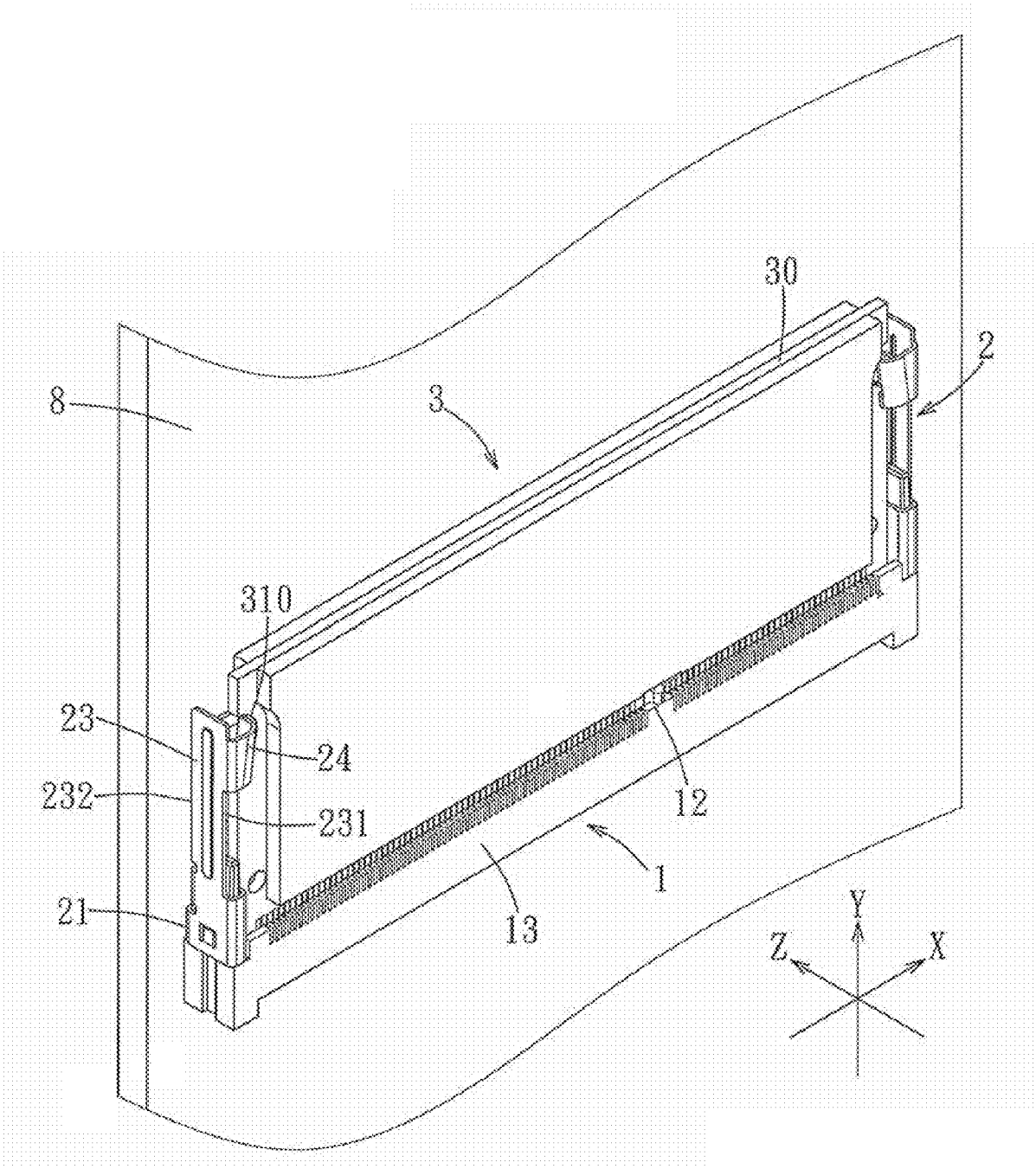
FIG. 4 is an assembled perspective front side view showing the preferred embodiment and the electronic card.
Figure 5:
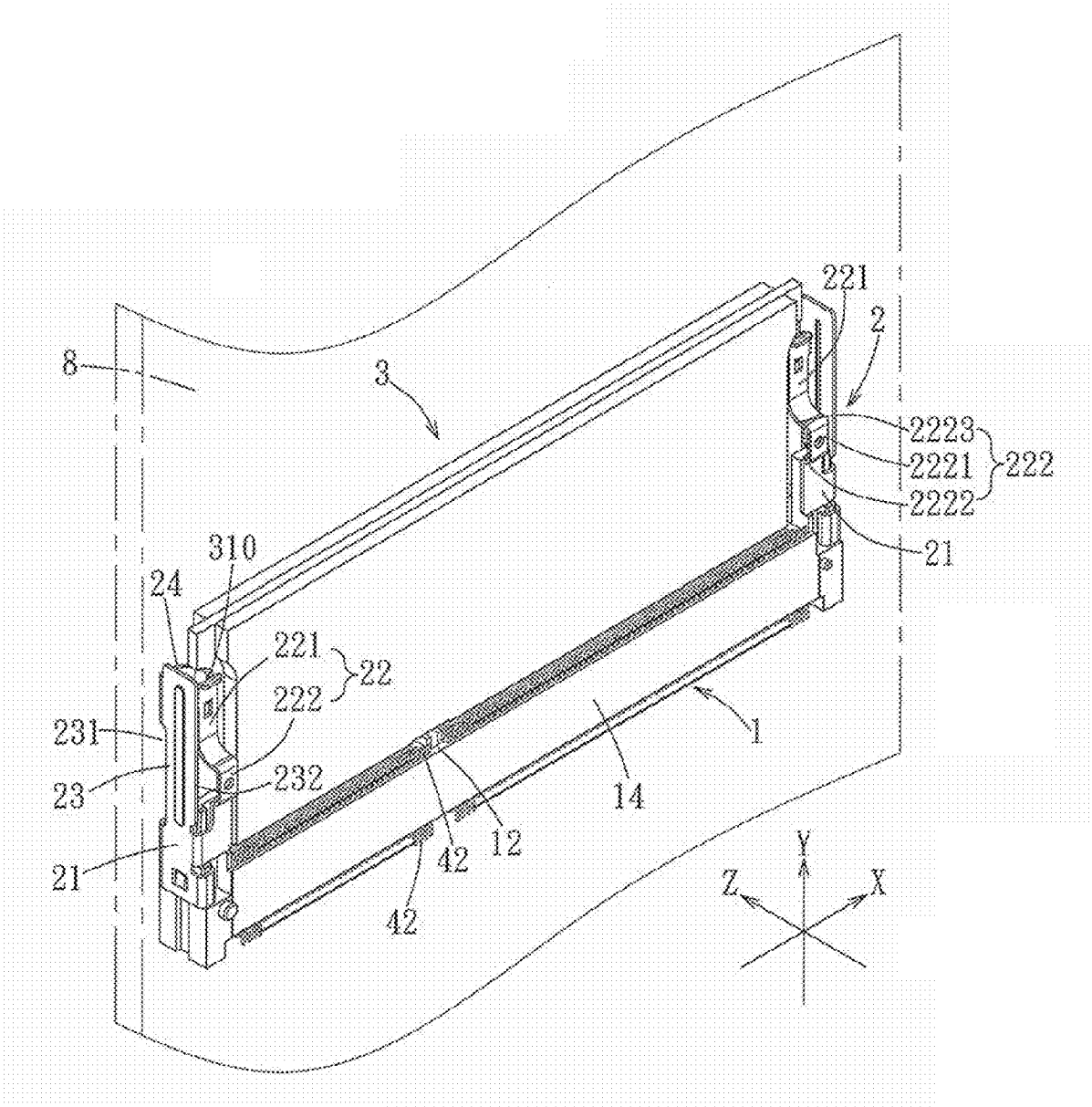
FIG. 5 is an assembled perspective rear side view showing the preferred embodiment and the electronic card.
Figure 6:
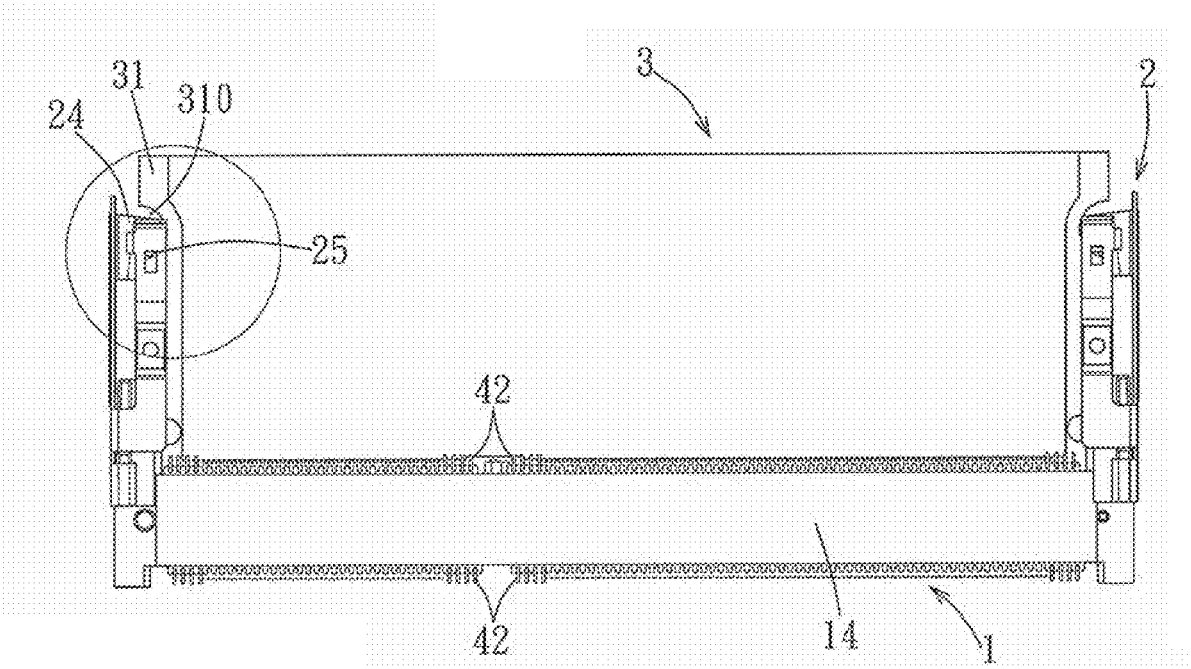
FIG. 6 is a schematic rear side view showing an assembly of the preferred embodiment and the electronic card.

The insulating body 1 is adapted to be mounted on the circuit board 8, and has a side surface 12 formed with an insertion groove 120 (see FIG. 3) which permits insertion of the insertion side 32 of the card body 30 of the electronic card 3, and two lateral side frames 11 opposite to each other in a first direction (X) and extending from the side surface 12. In this embodiment, as shown in FIGS. 4 and 5, the side surface 12 is a top surface, and the insulating body 1 further has a front surface 13, and a rear surface 14 that is adapted to be mounted on the circuit board 8.

The terminals 4 are mounted in the insulating body 1. As shown in FIG. 3, each terminals has a contact portion 41 extending into the insertion groove 120 in the insulating body 1, and a solder portion 42 opposite to the contact portion 41, extending outwardly of the insulating body 1 and adapted to be electrically connected to the circuit board 8. In this embodiment, the solder portions 42 of the terminals 4 are disposed adjacent to the rear surface 14 of the insulating body 1, as shown in FIG. 5. The contact portions 41 of the terminals 4 are adapted to contact electrically and respectively the conductive terminals 33 of the electronic card 3 when the insertion side 32 of the card body 30 of the electronic card 3 is inserted into the insertion groove 120 in the insulating body 1.

Figure 2:
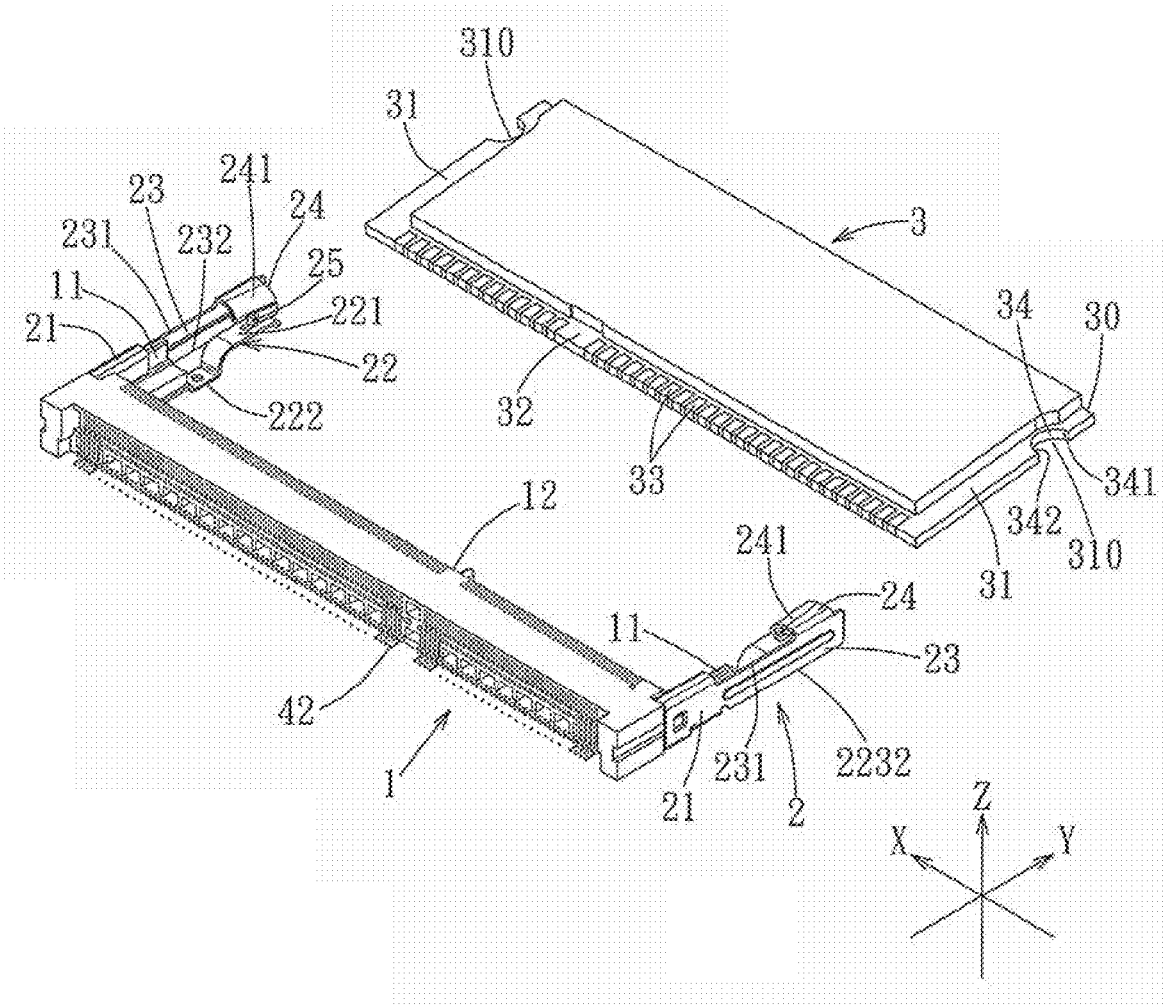
FIG. 2 is an exploded view showing the preferred embodiment of a card edge connector according to the present invention and an electronic card.

Each metallic piece 2 includes a base 21, a first resilient arm 23, a curved anchoring member 24, and a second resilient arm 22. For each metallic piece 2, the base 21 is mounted on a corresponding lateral side frame 11 of the insulating body 1. The first resilient arm 23 extends from tee base 21 in the second direction (Y) that is perpendicular to the first direction (X), and has first and second sides 231, 232 opposite to each other in a third direction (Z) that is perpendicular to the first and second directions (X, Y). The anchoring member 24 extends from the first side 231 of the first resilient arm 23, is disposed distal from the base 21, and has an outer convex guiding surface 241, as best shown in FIG. 2. The second resilient arm 22 extends from the base 21 and is disposed adjacent to the second side 232 of the first resilient arm 23, as best shown in FIG. 5. In this embodiment, the second resilient arm 22 has a free end portion 221, and a U-shaped end portion 222 connected between the free end portion 221 and the base 21. As shown in FIG. 5, the U-shaped and portion 222 of the second resilient arm 22 has a first arm section 2221 extending in the second direction (Y) and having two ends opposite to each other in the second direction (Y), a second arm section 2222 extending in the third direction (Z) and connected between one end of the first arm section 2221 and the base 21, and a third arm section 2223 extending in the third direction (Z), opposite to the second arm section 2222 in the second direction (Y) and connected between the other end of the first arm section 2221 and the free end portion 221. The free end portion 221 is opposite to the anchoring member 24 in the third direction (Z), and is formed with a projection 25 projecting toward the anchoring member 24. The projection 25 is forced by pressing in this embodiment.

Figure 7:
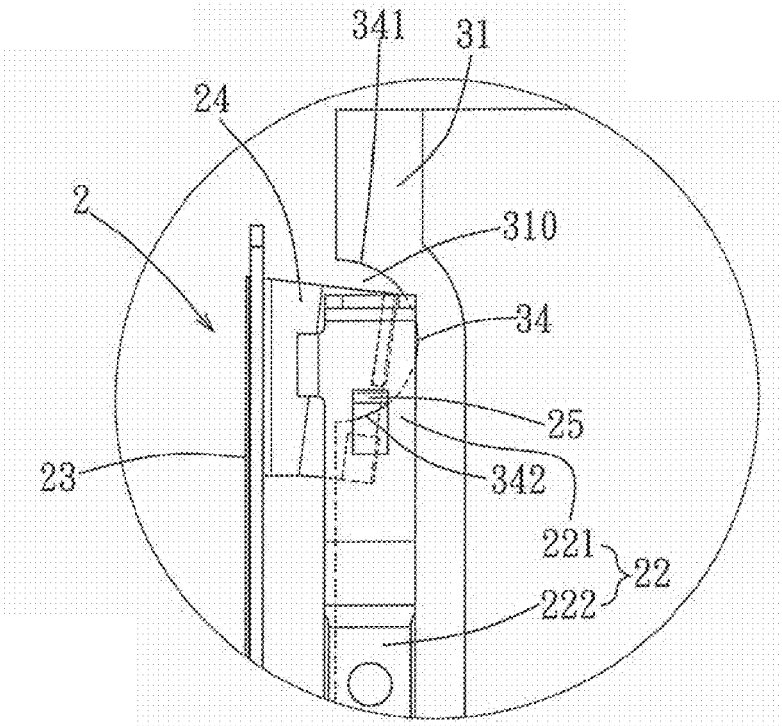
FIG. 7 is an enlarged schematic view showing an encircled portion of FIG. 6.

In use, initially, the insertion side 32 of the card body 30 of the electronic card 3 is inclinedly inserted into the insertion groove 120 in the insulating body 1 each that each lateral side 31 of the card body 30 of the electronic card 3 abuts against the guiding surface 241 of the anchoring member 24 of a corresponding metallic piece 2. Thereafter, the carp body 30 of the electronic card 3 is pushed to move toward the second resilient arms 22 of the metallic pieces 2 through guiding of the guiding surfaces 241 of the anchoring members 24 of the metallic pieces 2 such that each lateral side 31 of the card body 30 of the electronic card 3 is clamped between the anchoring member 24 and the free end portion 221 of the second resilient arm 22 of the corresponding metallic piece 2 and that the notch 310 in each lateral side 31 of the card body 30 of the electronic card 3 engages the projection 25 of the free end portion 221 of the second resilient arm 22 of the corresponding metallic piece 2, thereby ensuring electrical contact between the conductive terminals 33 of the electronic card 3 and the contact portions 41 of the terminals 4. It is noted that, when each lateral side 31 of the card body 30 of the electronic card 3 is clamped between the anchoring member 24 and the free end portion 221 of the second resilient arm 22 of the corresponding metallic piece 2, the projection 25 of the free end portion 221 of the second resilient arm 22 of the corresponding metallic piece 2 is adapted to abut against the second end 342 of the concave wall 34 at a respective lateral side 31 of the card body 30 of the electronic card 3, as best shown in FIG. 7, thereby preventing movement of the insertion side 32 of the card body 30 of the electronic card 3 away from the insertion groove 120 in the insulating body 1.

In sum, since the card body 30 of the electronic card 3 can be stably positioned relative to the card edge connector by the metallic pieces 2, the card edge connector of the present invention can ensure electrical contact between the conductive terminals 33 of the electronic card 3 and the contact portions 41 of the terminals 4.

While the present invention has been described in connection with what is considered the most practical and preferred embodiment, it is understood that this invention is not limited to the disclosed embodiment bat is intended to cover various arrangements included within the spirit and scope of the broadest interpretation so as to encompass all such modifications and equivalent arrangements.

What is claimed is:

1. A card edge connector adapted for electrically connecting an electronic card to a circuit board therethrough, the electronic card having a rectangular card body, the card body having an insertion side formed with a plurality of conductive terminals, and opposite lateral sides each formed with a notch distal from the insertion side, said card edge connector comprising:

an insulating body adapted to be mounted on the circuit board, and having a side surface formed with an insertion groove which permits insertion of the insertion side of the card body of the electronic card thereinto, and two lateral side frames opposite to each other in a first direction and extending from said side surface;

a plurality of terminals mounted in said insulating body, each of said terminals having a contact portion extending into said insertion groove in said insulating body, and a solder portion opposite to said contact portion, extending outwardly of said insulating body and adapted to be electrically connected to the circuit board, said contact portions of said terminals being adapted to contact electrically and respectively the conductive terminals of the electronic card when the insertion side of the card body of the electronic card is inserted into said insertion groove in said insulating body; and two metallic pieces each including a base mounted on a corresponding one of said lateral side frames of said insulating body, a first resilient arm extending from said base in a second direction that is perpendicular to the first direction, and having first and second sides opposite to each other in a third direction that is perpendicular to the first and second directions, a curved anchoring member extending from said first side of said first resilient arm portion, disposed distal from said base, and having an outer convex guiding surface, and a second resilient arm extending from said base and disposed adjacent to said second side of said first resilient arm, said second resilient arm having a free end portion opposite to said anchoring member in the third direction and formed with a projection projecting toward said anchoring member;

wherein, when the insertion side of the card body of the electronic card is inclinedly inserted into said insertion groove in said insulating body such that each of the lateral sides of the card body of the electronic card abuts against said guiding surface of said anchoring member or a corresponding one of said metallic pieces, the card body of the electronic card is pushed to move toward the second resilient arms of said metallic pieces through guiding of said guiding surfaces of said anchoring members of said metallic pieces such that each of the lateral sides of the card body of the electronic card is clamped between said anchoring member and said free end portion of said second resilient arm of the corresponding one of said metallic pieces and that the notch in each of the lateral sides of the card body of the electronic card engages said projection of said free end portion of said second resilient arm of the corresponding one of said metallic pieces, thereby ensuring electrical contact between the conductive terminals of the electronic card and said contact portions of said terminals.

2. The card edge connector as claimed in claim 1, wherein said second resilient arm of each of said metallic pieces further has a U-shaped end portion connected between said free end portion, and said base of a corresponding one of said metallic pieces.

3. The card edge connector as claimed in claim 2, wherein said U-shaped end portion of said second resilient arm of each of said metallic pieces has a first arm section extending in the second direction and having two ends opposite to each other in the second direction, a second arm section extending in the third direction and connected between one of said ends of said first arm section and said base of the corresponding one of said metallic pieces, and a third arm section extending in the third direction, opposite to said second arm section in the second direction and connected between the other one or said end of said first arm section and said free end portion.

4. The card edge connector as claimed in claim 1, wherein said projection of said free end portion of said second resilient arm of each of said metallic pieces is formed by pressing.

5. The card edge connector as claimed in claim 1, the notch in each of the lateral sides of the card body of the electronic card being defined by a concave wall that has a first end, and a second end opposite to the first end and closer to the insertion, side than the first end, wherein:

when each of the lateral sides of the card body of the electronic card is clamped between said anchoring member and said free end portion of said second resilient arm of the corresponding one of said metallic pieces, said projection of said free end portion of said second resilient arm of the corresponding one of said metallic pieces is adapted to abut against the second end of the concave wall at a respective lateral side of the card body of the electronic card.

* * * * *